US009255713B2

(12) United States Patent
Tisselli et al.

(10) Patent No.: US 9,255,713 B2
(45) Date of Patent: Feb. 9, 2016

(54) COOKING HOB WITH ILLUMINATION EQUIPMENT

(75) Inventors: Filippo Tisselli, Forlimpopoli (IT); Francesco Corleoni, Meldola (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 332 days.

(21) Appl. No.: 13/639,297

(22) PCT Filed: Apr. 19, 2011

(86) PCT No.: PCT/EP2011/001978

§ 371 (c)(1), (2), (4) Date: Oct. 4, 2012

(87) PCT Pub. No.: WO2011/131340

PCT Pub. Date: Oct. 27, 2011

(65) Prior Publication Data

US 2013/0032133 A1 Feb. 7, 2013

(30) Foreign Application Priority Data

Apr. 24, 2010 (EP) ..... 10004365

(51) Int. Cl.
*F21V 33/00* (2006.01)
*F24C 15/10* (2006.01)

(52) U.S. Cl.
CPC ..... *F24C 15/105* (2013.01)

(58) Field of Classification Search
CPC ..... F21V 33/00; F24C 15/10; H05B 3/68
USPC ..... 126/213, 39 BA, 41 R, 214 B; 219/457.1, 219/462.1
See application file for complete search history.

(56) References Cited

U.S. PATENT DOCUMENTS

| | | | | | |
|---|---|---|---|---|---|
| 3,663,798 | A | * | 5/1972 | Speidel et al. | 219/452.12 |
| 4,778,978 | A | * | 10/1988 | Schreder et al. | 219/451.1 |
| 4,788,414 | A | * | 11/1988 | Schreder | 219/451.1 |
| 5,422,460 | A | * | 6/1995 | Bralia et al. | 219/452.12 |
| 5,448,036 | A | * | 9/1995 | Husslein et al. | 219/445.1 |
| 5,813,320 | A | * | 9/1998 | Frasnetti et al. | 99/333 |
| 7,425,690 | B2 | * | 9/2008 | Schilling | 219/451.1 |

(Continued)

FOREIGN PATENT DOCUMENTS

| | | |
|---|---|---|
| DE | 19856538 | 5/2000 |
| DE | 10137919 | 6/2002 |
| WO | 2008029627 | 3/2008 |
| WO | 2008042805 | 4/2008 |
| WO | 2008128900 | 10/2008 |

OTHER PUBLICATIONS

International Search Report for PCT/EP2011/001978 dated May 23, 2011, 3 pages.

*Primary Examiner* — Avinash Savani
(74) *Attorney, Agent, or Firm* — Pearne & Gordon LLP

(57) ABSTRACT

The present invention relates to a cooking hob with illumination equipment. The cooking hob includes at least one transparent or semitransparent panel (10) arranged at the top side of said cooking hob. Further, the cooking hob includes at least one frame (12) enclosing at least partially the panel (10). A plurality of lighting elements (14) is arranged within the frame (12) and beside a narrow side of the panel (10). The frame (12) comprises at least one opening (16) on at least one inner side of said frame (12), so that the cooking hob and/or the environment above said cooking hob are illuminated out of the frame (12).

19 Claims, 1 Drawing Sheet

(56) References Cited

U.S. PATENT DOCUMENTS

Figure 1:
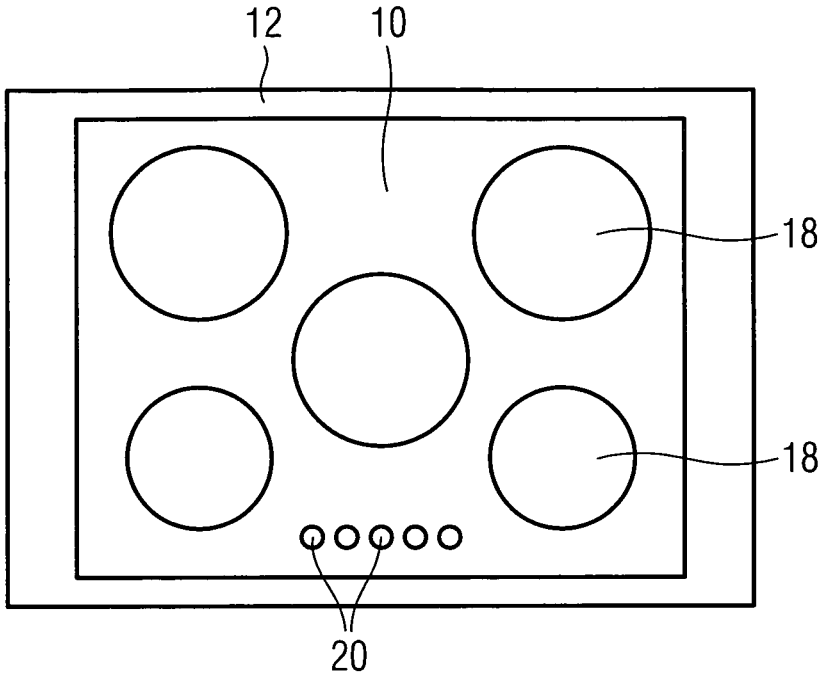

2002/0053563 A1* 5/2002 Pastore et al. ..... 219/448.11
2002/0113061 A1* 8/2002 Hammelsbacher et al. .. 219/506
2003/0183617 A1 10/2003 Platt
2005/0029245 A1* 2/2005 Gerola et al. ..... 219/447.1
2007/0084854 A1* 4/2007 Huber ..... 219/457.1
2008/0099449 A1* 5/2008 England et al. ..... 219/121.48
2010/0155387 A1* 6/2010 Le Gall et al. ..... 219/465.1

* cited by examiner

COOKING HOB WITH ILLUMINATION EQUIPMENT

The present invention relates to a cooking hob with illumination equipment.

Domestic cooking hobs require lighting effects. For example, the lighting effects have aesthetic functions, so that the design of the cooking hob can be improved. Further, the lighting effects can signal the actual state of the cooking hob to the user. Additionally, the lighting effects of the cooking hob may provide a contribution for illuminating the kitchen.

DE 10 2005 060 359 A1 discloses a cooking oven with an oven cavity and a cooking hob above said oven cavity. Between the oven cavity and the cooking hob a number of light sources are arranged. A part of the light sources is directed downwards for illuminating the oven cavity. Another part of the light sources is directed upwards for illuminating a panel of the cooking hob, so that the environment of the panel is indirectly illuminated.

EP 2 085 702 A2 discloses an illuminated panel of a cooking hob. The panel comprises laser engravings. Light emitting diodes are arranged at the narrow sides of the panel. The light from the light emitting diodes is coupled into the panel, so that the laser engravings seem to be active luminous objects.

It is an object of the present invention to provide an improved cooking hob with illumination equipment, which has low cost of materials and low complexity.

The object of the present invention is achieved by the induction cooking hob according to claim 1.

The present invention relates to a cooking hob with illumination equipment, wherein:

- the cooking hob includes at least one transparent or semi-transparent panel arranged at the top side of said cooking hob,
- the cooking hob includes at least one frame enclosing at least partially the panel,
- a plurality of lighting elements is arranged within the frame and beside a narrow side of the panel, and
- the frame comprises at least one opening on at least one inner side of said frame,
- so that the cooking hob and/or the environment above said cooking hob are illuminated out of the frame.

The main idea of the present invention is the geometric structure of the frame enclosing the panel and the arrangement of the plurality of lighting elements within the frame. Thus, the cooking hob as well the environment above said cooking hob can be illuminated out of the frame. The user does not see an direct light radiation form the lighting elements.

According to a preferred embodiment of the present invention the lighting elements and the at least one opening are arranged for generating at least one luminous pattern on the cooking hob and/or in the environment above said cooking hob. Said luminous pattern may have a special design for aesthetic purposes. Further, the luminous pattern may symbolize a certain operation mode of the cooking hob. For example, a part of the luminous pattern can indicate the actual temperature of a corresponding heating zone.

Preferably, the frame comprises at least partially a U-shaped cross-section, wherein the open side of said U-shaped cross-section is arranged at the inner side or sides of the frame. The U-shaped cross-section allows that the light is only directed to the inner space within the frame. Additionally, the inner side of the U-shaped cross-section may comprise a reflective layer, so that more light is directed to the inner space between the frame, i.e. into the panel.

In particular, the lighting element is or comprises one or a set of light emitting diodes (LED). The light emitting diodes are small and consume low energy. The light emitting diodes can generate light with different colours.

According to the preferred embodiment of the present invention the frame is made of metal, in particular frame is made of aluminium.

Further, the frame is a heat sink for the lighting elements. This heat sink prevents an overheating of the frame and the lighting element.

In a special embodiment, the panel comprises at least one reflective layer on the lower side of said panel. The reflective layer increases the light efficiency of the panel.

In a similar way, the panel comprises at least one light scattering layer on the upper side of said panel. In this case, the upper side of the panel seems to be an active luminous object.

Further, the lighting elements may comprise different colours or at least one combination of different colours. The different colours may have an aesthetic function and/or an informative character.

For example, the illumination equipment provides information about the state of the cooking hob.

Further, the illumination equipment may include a night light system. Such a night light system has low energy consumption and is arranged at a suitable place.

Preferably, the panel is made of glass, tempered glass and/or glass ceramic.

For example, the cooking hob comprises at least one electric heating element. In this case, the cooking hob may comprise at least one induction coil and/or at least one radiant heater.

Alternatively or additionally, the cooking hob comprises at least one gas burner.

Novel and inventive features of the present invention are set forth in the appended claims.

Figure 2:
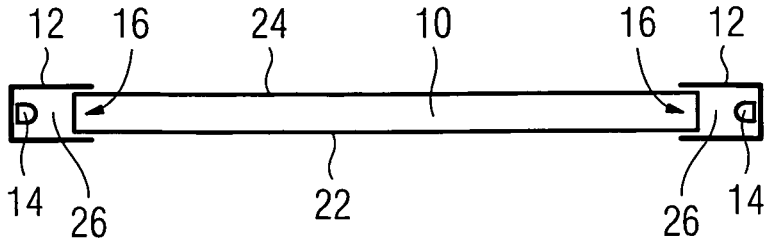

The present invention will be described in further detail with reference to the drawings, in which FIG. 1 illustrates a schematic top view of a cooking hob with illumination equipment according to a preferred embodiment of the present invention, and FIG. 2 illustrates a schematic sectional front view of the cooking hob with illumination equipment according to the preferred embodiment of the present invention.

FIG. 1 illustrates a schematic top view of a cooking hob with illumination equipment according to a preferred embodiment of the present invention. The cooking hob comprises heating zones 18 and control elements 20.

The cooking hob may be an electric or a gas powered cooking hob. For example, the electric cooking hob may be an induction cooking hob with induction coils or a conventional electric cooking hob with radiant heating elements.

The cooking hob comprises a panel 10 and a frame 12. The panel 10 is made of a transparent or a semitransparent material. For example, the panel 10 is made of glass, tempered glass or glass ceramics. The heating zones 18 and the control elements 20 are arranged on the panel 10.

The frame 12 encloses the panel 10. The frame 12 has a U-shaped cross-section, wherein the open side of said U-shaped cross-section is directed inwards to the panel 10. In this example, the front side and the rear side of the frame 12 enclose the panel 10 substantially form-closed. However, in the left hand side and in the right hand side of the frame 12 there remains a longitudinal hollow space 26 in each case. The cross-section of the hollow space 26 is limited by the U-shaped cross-section of the frame 12 and the outer side of the panel 10.

FIG. 2 illustrates a schematic sectional front view of the cooking hob with illumination equipment according to the preferred embodiment of the present invention. FIG. 2 clarifies the arrangement of the panel 10 within the frame 12.

The open side of the U-shaped cross-section of the frame 12 is directed to the panel 10. In FIG. 2 the sectional side view of the left hand side and right hand side of the frame 12 are shown. The hollow spaces 26 in the left hand side and right hand side of the frame 12 extend perpendicular to the plane of projection.

In the hollow spaces 26 a series of lighting element 14 is arranged in each case. In this example, the lighting elements 14 are light emitting diodes (LED). The lighting elements 14 are arranged parallel to the left and right narrow sides of the panel 10.

Further, the panel 10 comprises a reflective layer 22 and a light scattering layer 24. The reflective layer 22 is applied at the lower side of the panel 10. The light scattering layer 24 is applied at the upper side of the panel 10.

The light generated by the lighting elements 14 is coupled into the panel 10 via its laterally narrow sides. Preferably the inner sides of the frame 12 comprise reflective layers, so that additional light is reflected and coupled into the layer 10.

Within the layer 10 the light is reflected by the reflective layer 22 at the lower side of the said panel 10. Thus, there is no light radiating downwardly below the panel 10.

The light scattering layer 24 effects diffuse reflections of the inclined light, so that a substantial part of the light radiates upwardly from the upper side of the panel 10. Thus, the light scattering layer 24 seems like a luminous object.

In the preferred embodiment of the present invention the frame is made of metal. In particular, the frame is made of aluminium. The frame 12 protects the lighting elements from water and dirt. Since metals, in particular aluminium, have very high heat conductivity, the frame is provided as a heat sink for the lighting elements 14. This heat sink prevents an overheating of the frame 12 and the lighting elements 14.

The lighting elements 14 may be activated by a dedicated user interface, e.g. by one or more of the control elements 20. Alternatively or additionally, the lighting elements 14 may be activated by a logic circuit. For example, one or some of the lighting elements 14 are activated, if any of the heating zones 18 has been activated. Further, one or some of the lighting elements 14 are activated, if the presence of a person has been detected in the kitchen by a sensor.

The lighting elements 14 can give information about the cooking hob to the user. For example, one or some of the lighting elements 14 are activated, if a cooking vessel is placed in the heating zone 18. In a similar way, one or some of the lighting elements 14 are activated, if water is boiling.

Further, one or some of the lighting elements 14 are activated, if a certain temperature has been reached. The intensity and/or the colour of the light may depend on the temperature.

Additionally, a residual heat may be indicated by one or some of the lighting elements 14, after the cooking hob has been switched off. At last, one or some of the lighting elements 14 are provided as a night light system.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 panel
12 frame
14 lighting element
16 opening
18 heating zone
20 control element
22 reflective layer
24 light scattering layer
26 hollow space

The invention claimed is:

1. A cooking hob with illumination equipment, wherein:
the cooking hob includes at least one transparent or semi-transparent panel (10) arranged at a top side of said cooking hob,
the cooking hob includes at least one frame (12) enclosing at least partially the panel (10), the frame comprising at least partially a U-shaped cross-section,
the cooking hob includes a hollow space defined by the U-shaped cross-section and an outer side of the panel (10),
a plurality of lighting elements (14) is arranged within the hollow space defined by the frame (12) and beside a narrow side of the panel (10), and
the frame (12) comprises at least one opening (16) on at least one inner side of said frame (12),
so that the cooking hob and/or the environment above said cooking hob are illuminated out of the frame (12),
wherein the panel (10) comprises two opposing broad sides and the narrow side extends between the opposing broad sides and meets with edges of the opposing broad sides, further wherein the narrow side is narrower than the opposing broad sides.

2. The cooking hob according to claim 1, wherein the lighting elements (14) and the at least one opening (16) are arranged for generating at least one luminous pattern on the cooking hob and/or in the environment above said cooking hob.

3. The cooking hob according to claim 1, wherein the open side of said U-shaped cross-section is arranged at the inner side or inner sides of the frame (12).

4. The cooking hob according to any claim 1, wherein the lighting element (14) is or comprises one or a set of light emitting diodes.

5. The cooking hob according claim 1, wherein the frame (12) is made of metal.

6. The cooking hob according to claim 4, wherein the frame (12) is a heat sink for the lighting elements (14).

7. The cooking hob according to claim 1, wherein the panel (10) comprises at least one reflective layer on the lower side of said panel (10).

8. The cooking hob according to claim 1, wherein the panel (10) comprises at least one light scattering layer on the upper side of said panel (10).

9. The cooking hob according to claim 1, wherein the lighting elements (14) comprise different colours or at least one combination of different colours.

10. The cooking hob according to claim 1, wherein the illumination equipment provide information about the state of the cooking hob.

11. The cooking hob according to claim 1, wherein the illumination equipment includes a night light system.

12. The cooking hob according to claim 1, wherein the panel (10) is made of glass, tempered glass and/or glass ceramic.

13. The cooking hob according to claim 1 wherein the cooking hob comprises at least one electric heating element.

14. The cooking hob according to claim 13, wherein the cooking hob comprises at least one induction coil and/or at least one radiant heater.

15. The cooking hob according to claim 1, wherein the cooking hob comprises at least one gas burner.

16. The cooking hob according to claim 1, wherein the plurality of lighting elements (14) are arranged such that light generated by the plurality of lighting elements (14) enters the panel (10) through the narrow side of the panel (10).

17. The cooking hob according to claim 1, wherein a front side and a rear side of the frame (12) encloses the panel (10) substantially form-closed.

18. The cooking hob according to claim 1, wherein the U-shaped cross-section opens towards the narrow side such that light emitted by the plurality of lighting elements (14) is directed into the narrow side.

19. The cooking hob according to claim 18, wherein the U-shaped cross-section comprises an upper leg that extends above one of the opposing broad sides of the panel (10) and a lower leg that extends below the other of the opposing broad sides, thereby enclosing an edge portion of the panel (10).

* * * * *